US008926339B2

(12) United States Patent
Houtz

(10) Patent No.: US 8,926,339 B2
(45) Date of Patent: Jan. 6, 2015

(54) ELECTRICAL CONNECTOR HAVING POSITIONING ASSEMBLY

(75) Inventor: Timothy W. Houtz, Etters, PA (US)

(73) Assignee: FCI Americas Technology LLC, Carson City, NV (US)

( * ) Notice: Subject to any disclaimer, the term of this patent is extended or adjusted under 35 U.S.C. 154(b) by 210 days.

(21) Appl. No.: 13/546,241

(22) Filed: Jul. 11, 2012

(65) Prior Publication Data

US 2013/0017711 A1 Jan. 17, 2013

Related U.S. Application Data

(60) Provisional application No. 61/508,321, filed on Jul. 15, 2011.

(51) Int. Cl.

| | |
|---|---|
| ***H01R 12/00*** | (2006.01) |
| ***H01R 13/66*** | (2006.01) |
| ***H01R 13/504*** | (2006.01) |
| *H01R 13/64* | (2006.01) |

(52) U.S. Cl.

CPC ..... *H01R 13/6658* (2013.01); *H01R 13/5045* (2013.01); *H01R 13/64* (2013.01)

USPC ..... 439/76.1

(58) Field of Classification Search

USPC ..... 439/76.1, 493, 946

See application file for complete search history.

(56) References Cited

U.S. PATENT DOCUMENTS

| | | | | | |
|---|---|---|---|---|---|
| 3,740,698 | A | * | 6/1973 | Jerominek | 439/61 |
| 4,331,370 | A | * | 5/1982 | Andrews et al. | 439/75 |
| 4,528,616 | A | * | 7/1985 | Koppensteiner | 361/752 |
| 4,639,054 | A | * | 1/1987 | Kersbergen | 439/59 |
| 4,801,924 | A | * | 1/1989 | Burgmann et al. | 340/521 |
| 4,824,383 | A | | 4/1989 | Lemke | |
| 4,964,815 | A | | 10/1990 | Kawai et al. | |
| 5,108,313 | A | | 4/1992 | Adams | |
| 5,190,471 | A | * | 3/1993 | Barile et al. | 439/455 |
| 5,322,447 | A | * | 6/1994 | Okada | 439/79 |
| 5,421,746 | A | | 6/1995 | David | |
| 5,580,271 | A | * | 12/1996 | Buchheister et al. | 439/493 |
| 5,609,499 | A | * | 3/1997 | Tan et al. | 439/445 |
| 5,679,008 | A | * | 10/1997 | Takahashi et al. | 439/76.1 |
| 5,709,555 | A | * | 1/1998 | Noschese | 439/79 |
| 5,797,771 | A | * | 8/1998 | Garside | 439/607.46 |
| 5,881,454 | A | * | 3/1999 | Baxter et al. | 29/843 |
| 5,920,459 | A | * | 7/1999 | Weber et al. | 361/752 |

(Continued)

FOREIGN PATENT DOCUMENTS

WO WO 2009/040613 4/2009

OTHER PUBLICATIONS

International Patent Application No. PCT/US2012/046389: International Search Report and Written Opinion, dated Jan. 28, 2013, 9 pages.

*Primary Examiner* — Neil Abrams
(74) *Attorney, Agent, or Firm* — Baker & Hostetler LLP

(57) ABSTRACT

An electrical connector includes a connector housing that supports at least one printed circuit board having a mating end and a mounting end. The connector housing includes a first housing portion and a second housing portion that is configured to attach to the first housing portion. The first housing portion supports the printed circuit board, and the second housing portion includes a positioning member that engages the printed circuit board so as to retain the printed circuit board in a predetermined position.

27 Claims, 7 Drawing Sheets

(56) References Cited

U.S. PATENT DOCUMENTS

| | | | | |
|---|---|---|---|---|
| 5,955,703 | A * | 9/1999 | Daly et al. | 174/117 R |
| 5,957,727 | A * | 9/1999 | Page, Jr. | 439/607.58 |
| 6,190,196 | B1 * | 2/2001 | Kato | 439/493 |
| 6,213,815 | B1 * | 4/2001 | Wu | 439/638 |
| 6,290,530 | B1 * | 9/2001 | Chang | 439/378 |
| 6,386,919 | B2 * | 5/2002 | Medina et al. | 439/607.46 |
| 6,431,887 | B1 * | 8/2002 | Yeomans et al. | 439/108 |
| 6,499,890 | B2 * | 12/2002 | Gilliland et al. | 385/88 |
| 6,565,388 | B1 | 5/2003 | Van Woensel et al. | |
| 6,685,511 | B2 * | 2/2004 | Akama et al. | 439/607.46 |
| 6,778,401 | B1 * | 8/2004 | Yu et al. | 361/752 |
| 6,872,094 | B1 * | 3/2005 | Murr et al. | 439/607.2 |
| 6,942,395 | B1 * | 9/2005 | Chuan et al. | 385/53 |
| 6,984,133 | B2 | 1/2006 | Naitou et al. | |
| 7,223,915 | B2 * | 5/2007 | Hackman | 174/36 |
| 7,597,488 | B2 * | 10/2009 | Fisher | 385/94 |
| 7,883,341 | B2 * | 2/2011 | Lang et al. | 439/76.1 |
| 7,922,520 | B2 * | 4/2011 | Mizukami | 439/493 |
| 7,997,909 | B2 * | 8/2011 | Xu et al. | 439/76.1 |
| 8,011,948 | B2 * | 9/2011 | Wu | 439/358 |
| 8,303,314 | B2 * | 11/2012 | Wu | 439/76.1 |
| 8,599,567 | B2 * | 12/2013 | Wu | 361/752 |
| 8,625,270 | B2 * | 1/2014 | Ni et al. | 361/679.31 |
| 8,770,990 | B2 * | 7/2014 | Sytsma et al. | 439/76.1 |
| 2006/0040554 | A1 * | 2/2006 | Liu | 439/607 |
| 2007/0111598 | A1 | 5/2007 | Quilici | |
| 2008/0318479 | A1 * | 12/2008 | Perrier et al. | 439/620.22 |

* cited by examiner

ELECTRICAL CONNECTOR HAVING POSITIONING ASSEMBLY

CROSS-REFERENCE TO RELATED APPLICATIONS

This claims the benefit of U.S. patent application Ser. No. 61/508,321 filed Jul. 15, 2011, the disclosure of which is hereby incorporated by reference as if set forth in its entirety herein.

BACKGROUND

Electrical connectors provide signal connections between electronic devices using signal contacts. In certain embodiments, the electrical connector includes a connector housing that supports at least one circuit board, such as a paddle card, that defines a mounting end configured to be mounted to a complementary electrical component, such as a cable. The circuit board further defines a mating end that is configured to mate with a complementary electrical component. It is desirable to ensure that the circuit board is retained in a desired position with respect to the housing.

SUMMARY

In accordance with one embodiment, an electrical connector is configured to mate with a complementary electrical component. The electrical connector includes at least one substrate that defines at least one positioning member. The electrical connector further includes a first housing portion that is configured to receive the at least one substrate along a predetermined direction so as to support the at least one substrate. The electrical connector further includes a second housing portion that includes at least one positioning member that is configured to engage the at least one positioning member of the at least one substrate so as to at least limit the at least one substrate from moving along the predetermined direction with respect to the first housing portion when the first and second housing portions are attached to each other.

BRIEF DESCRIPTION OF THE DRAWINGS

The foregoing summary, as well as the following detailed description of a preferred embodiment, are better understood when read in conjunction with the appended diagrammatic drawings. For the purpose of illustrating the present disclosure, reference to the drawings is made. The scope of the disclosure is not limited, however, to the specific instrumentalities disclosed in the drawings. In the drawings.

DETAILED DESCRIPTION

Figure 1A:
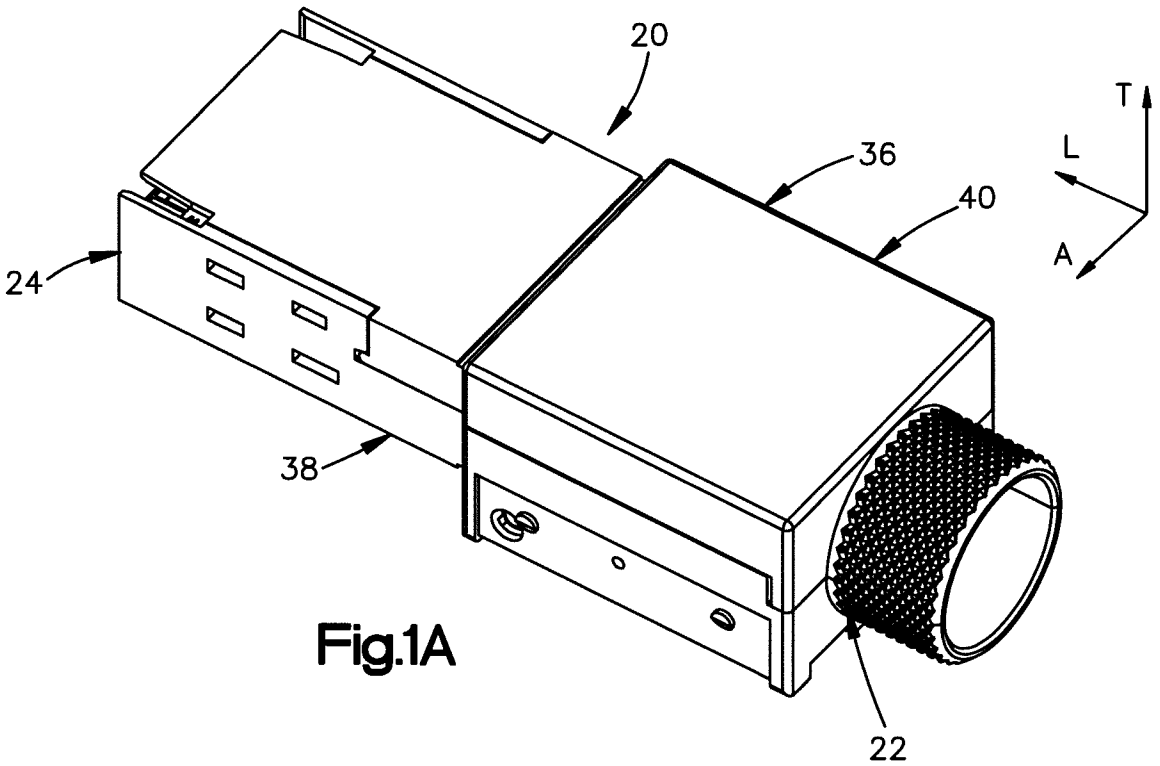
FIG. 1A is a perspective view of an electrical connector constructed in accordance with one embodiment, including a first housing portion and a second housing portion.
Figure 1B:
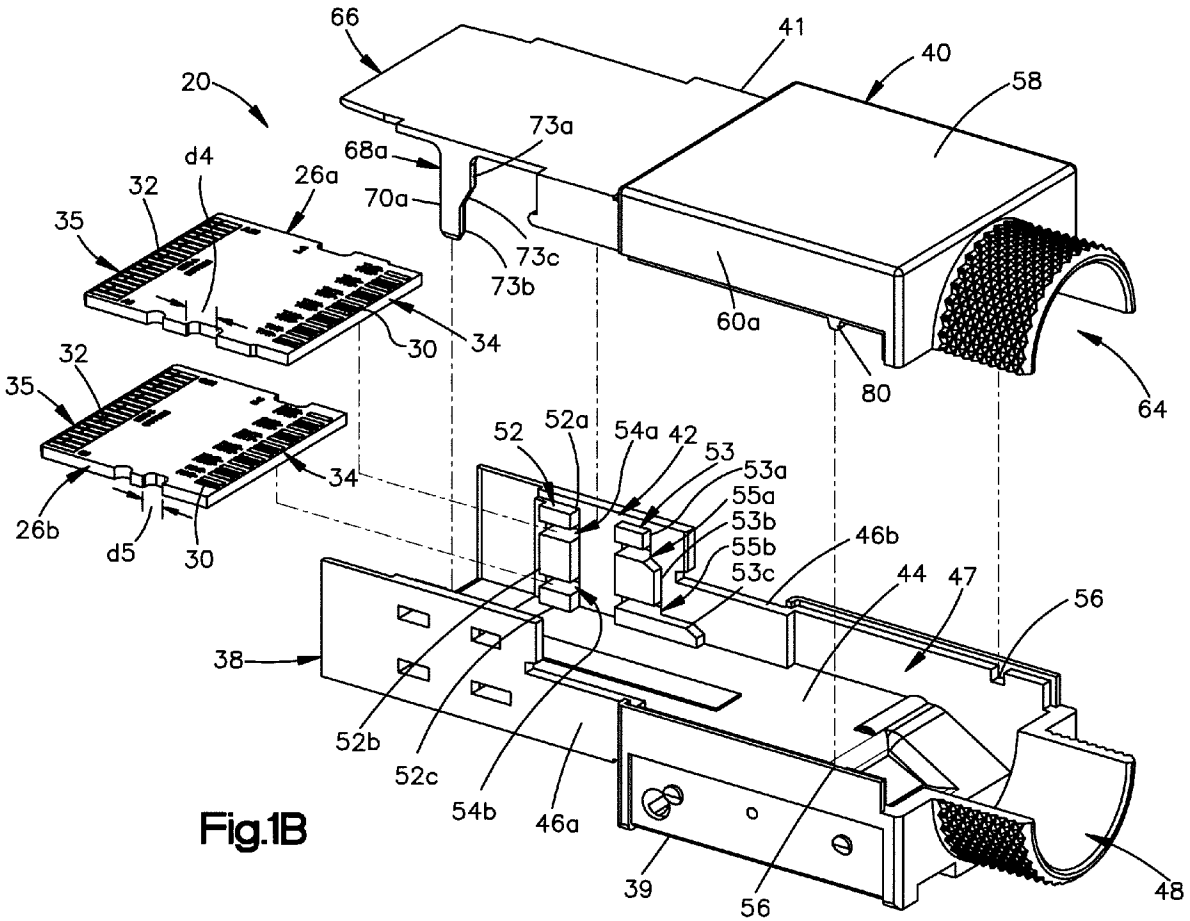
FIG. 1B is an exploded assembly view of the electrical connector illustrated in FIG. 1A, further including first and second printed circuit boards.
Figure 1C:
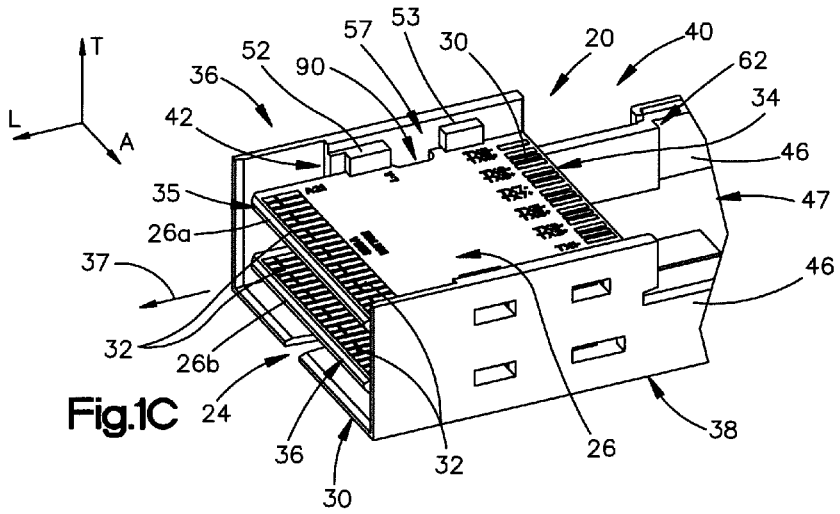
FIG. 1C is a perspective view of the electrical connector illustrated in FIG. 1B, but showing the first and second printed circuit board supported by the first housing portion, and showing the second housing portion removed.
Figure 1D:
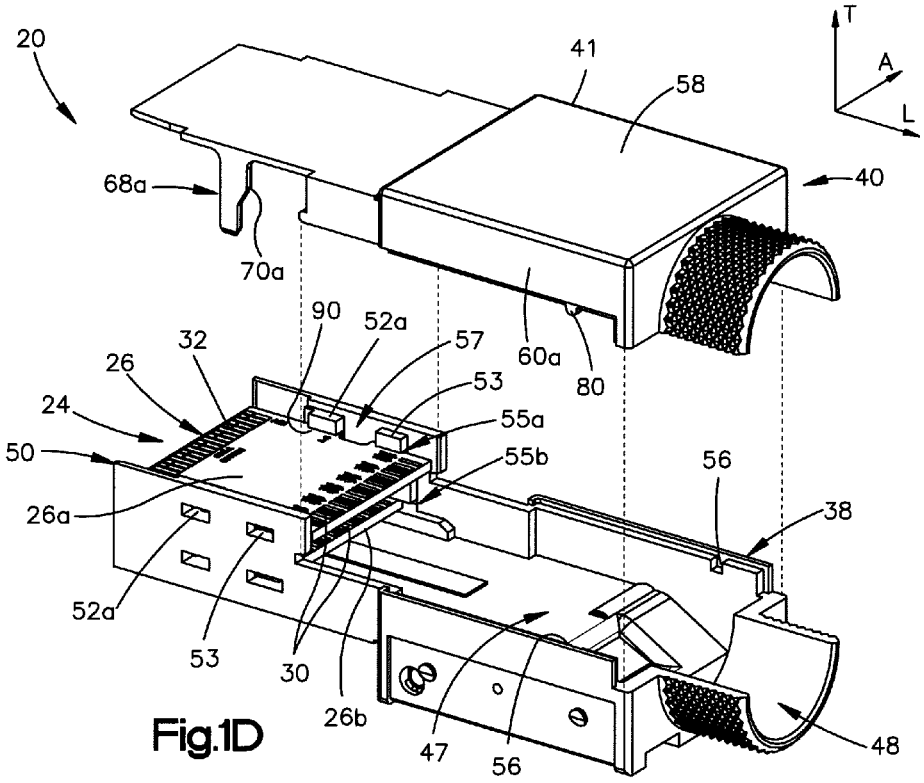
FIG. 1D is an exploded assembly view of the electrical connector illustrated in FIG. 1A, but showing the first and second printed circuit board supported by the first housing portion.

Referring initially to FIGS. 1A-C, an electrical connector 20 defines a mounting interface 22 that is configured to mount to a first complementary electrical component so as to establish an electrical connection with the first complementary electrical component, and a mating interface 24 configured to mate with a second complementary electrical component so as to establish an electrical connection with the second complementary electrical component. Thus, the electrical connector 20 is configured to establish an electrical connection between the first and second complementary electrical components. In accordance with one embodiment, the first electrical component can be a cable, such as a fiber optic cable, a power cable, or any suitable alternative cable or alternative electrical component as desired. The second complementary electrical component can be an electrical connector or alternative electrical component as desired.

The electrical connector 20 extends along a first or longitudinal direction L, a second or lateral direction A that is substantially perpendicular to the longitudinal direction L, and a third or transverse direction T that extends substantially perpendicular to the longitudinal direction L and the lateral direction A. As illustrated, the longitudinal direction L and the lateral direction A extend horizontally, and the transverse direction T extends vertically, though it should be appreciated that these directions may change depending, for instance, on the orientation of the electrical connector 20 during use. Unless otherwise specified herein, the terms "lateral," "longitudinal," and "transverse" are used to describe the perpendicular directional components of various components. The terms "inboard" and "inner," and "outboard" and "outer" with respect to a specified directional component are used herein with respect to a given apparatus to refer to directions along the directional component toward and away from the center apparatus, respectively.

In accordance with the illustrated embodiment, the mounting interface 22 is spaced from the mating interface 24 along the longitudinal direction L, and is aligned with the mating interface 24 along the longitudinal direction L. Thus, as shown, the electrical connector 20 can be a vertical connector whereby the mounting interface 22 is oriented substantially parallel to the mating interface 24. Alternatively, the electrical connector 20 can be a right-angle connector whereby the mounting interface 22 is oriented substantially perpendicular to the mating interface 24.

The electrical connector 20 can include at least one substrate 26, such as a first substrate 26*a* and a second substrate 26*b*, which can each define a printed circuit board (PCB). While the electrical connector 20 includes a pair of substrates 26, it should be appreciated that the electrical connector 20 can include any number of substrates as desired. Each substrate 26 can include electrical contact pads 30 that define a mounting end 34 of the respective substrate 26 that is configured to electrically connect to the first electrical component when the electrical connector 20 is mounted to the first electrical component, and contact pads 32 that define a mating end 35 of the substrate 26 that is configured to electrically connect to the second electrical component when the electrical connector is mated to the second electrical component. Thus, the mounting ends 34 of the substrates 26*a-b* are disposed closer to the mounting end 22 of the electrical connector 20 than the mating end 24, and the mating ends 35 of the substrates 26*a-b* are disposed closer to the mating end 24 of the electrical connector 20 than the mounting end 22. Each substrate 26*a* and 26*b* can include electrical traces that are connected between the electrical contact pads 30 and 32, thereby placing the electrical contact pads 30 and 32 of each individual substrate in electrical communication with each other. The first complementary electrical component, such as the cable, can be attached, for instance soldered, to the contact pads 30 at the mounting end 34. The electrical connector 20 can be mated with the second complementary electrical component along a first longitudinal mating, or insertion, direction 37, so as to place the first and second complementary electrical components in electrical communication with each other. The electrical connector 20 can further be unmated from the second complementary electrical component along a second longitudinal direction that is opposite the first longitudinal direction.

The electrical connector 20 can further include a dielectric or electrically insulative connector housing 36 that supports the substrates 26*a-b* in a desired predetermined position so as to facilitate mating with the second complementary electrical component. The connector housing 36 includes a first or lower housing portion 38, and a second or upper housing portion 40 that is configured to be attached to the lower housing portion 38. For instance, the first and second housing portions 38 and 40 can be dimensioned so as to be press-fit together, or can alternatively or additionally be attached using any suitable fastener. As is described in more detail below, the electrical connector 20 includes a positioning assembly 42 that supports the substrates 26 in a desired predetermined position with respect to the connector housing 36 so as to facilitate reliable connection with the second complementary electrical component.

Referring also to FIG. 2, the first housing portion 38 includes a first housing portion body 39 that defines a base 44 that can also define the base of the connector housing 36, a first side wall 46*a* that extends out along the transverse direction T (or vertically up) from the base 44, and a second side wall 46*b* that is opposite the first side wall 46*a* with respect to the lateral direction A, and also extends out along the transverse direction T (or vertically up) from the base 44. The base 44 and the side walls 46 define a first interior portion 47 of the first housing portion 38. The first housing portion 38 defines first or front end 48 and a second or rear end 50 that is rearwardly spaced from the first or front end 48 along the longitudinal direction L. Thus, the first or front end 48 is forwardly spaced from the second or rear end 50 along the longitudinal direction L. The first end 48 can define a portion of the mounting interface 22, and can be shaped so as to correspond generally to a portion of an outer circumference of a cable, such that the cable can extend through the first end 48 and into the interior 47. Thus, the first end 48 can be referred to as an open end that is configured to receive a cable. The second end 50 is configured to receive the first and second substrates 26*a-b*, and can thus also be referred to as an open end. While the first housing portion 38 has been described in accordance with the illustrated embodiment, it should be appreciated that the first housing portion 38 can define any suitable alternative shape and size as desired.

Figure 2A:
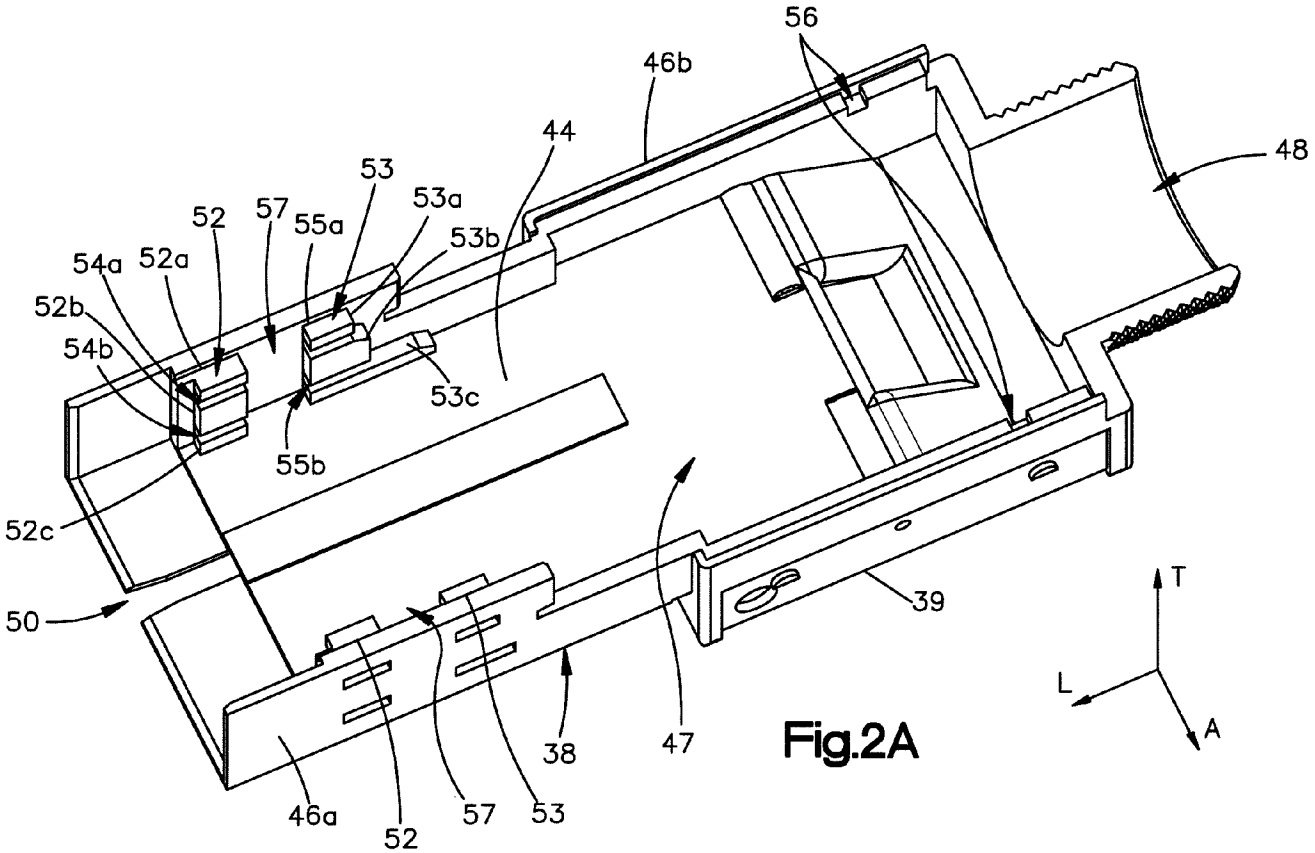
FIG. 2A is a perspective view of the first housing portion illustrated in FIG. 1A.
Figure 2B:
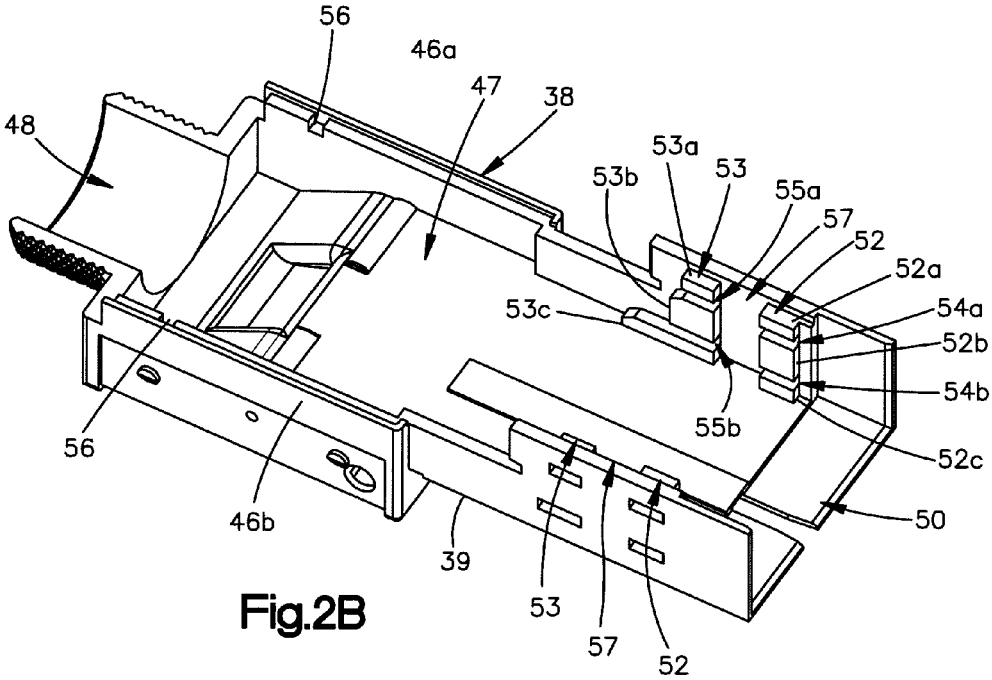
FIG. 2B is another perspective view of the first housing portion illustrated in FIG. 1A.

Referring also to FIGS. 2A-B, the first housing portion 38 can further define at least one guide member, such as first and second guide members 52 and 53, respectively, that project inwardly from each of the side walls 46*a-b* into the interior 47 along the lateral direction A and cooperate so as to guide the first and second substrates 26*a* and 26*b* into the first housing portion 38. The first guide member 52 is spaced rearwardly from the second guide member 53 along the longitudinal direction L, and thus is spaced between the second guide member 53 and the second end 50, so as to define a void 57 between the first and second guide members 52 and 53 along the longitudinal direction L. The first and second guide members 52 and 53, and the resulting void 57, that are carried by the first side wall 46*a* can be substantially aligned along the lateral direction A with the first and second guide members 52 and 53, and the resulting void 57, that are carried by the second side wall 46*b*. It should be appreciated, however, that the first and second guide members 52 and 53, and the resulting void 57, of the first and second side walls 46*a-b* can be offset along the longitudinal direction L as desired.

In accordance with the illustrated embodiment, each of the first guide members 52 can define a plurality of protrusions including first, second, and third protrusions 52*a*, 52*b*, and 52*c*, respectively, that extend in from the respective side walls 46*a-b* into the interior 47 of the first housing portion 38. The first, second, and third protrusions 52*a*, 52*b*, and 52*c* are spaced sequentially down from each other along the transverse direction toward the base 44 of the first housing portion 38. Thus, the third protrusion 52*c* is spaced from the base 44 a distance less than the first and second protrusions 52*a* and 52*b* are spaced from the base 44. The second protrusion 52*b* is spaced from the base 44 a distance greater than the distance that the third protrusion 52*c* is spaced from the base 44, and less than the distance that the first protrusion 52*a* is spaced from the base 44. The third protrusion 52*c* is spaced from the base 44 a distance less than the distance that the first and second protrusions 52*a-b* are spaced from the base 44. Otherwise stated, the third protrusion 52*c* is disposed between the second protrusion 52*b* and the base 44 along the transverse direction T, and the second protrusion 52*b* is disposed between the first and third protrusions 52*a* and 52*c* along the transverse direction T. Thus, the first and third protrusions 52*a* and 52*c* can be referred to as first and second outer protrusions, and the second protrusion 52*b* can be referred to as a middle protrusion that is spaced between the first and second outer protrusions along the transverse direction T. The protrusions 52*a-c* can define embossments of the respective first and second side walls 46*a-b*, or can be otherwise supported by the first and second side walls 46*a-b*, for instance attached to the first and second side walls 46*a-b*, as desired.

In accordance with the illustrated embodiment, each of the second guide members 53 can define a plurality of protrusions including first, second, and third protrusions 53*a*, 53*b*, and 53*c*, respectively, that extend in from the respective side walls 46*a-b* into the interior 47 of the first housing portion 38. The first, second, and third protrusions 53*a*, 53*b*, and 53*c* are spaced sequentially down from each other along the transverse direction toward the base 44 of the first housing portion 38. Thus, the third protrusion 53*c* is spaced from the base 44 a distance less than the first and second protrusions 53*a* and 53*b* are spaced from the base 44. The second protrusion 53*b* is spaced from the base 44 a distance greater than the distance that the third protrusion 53*c* is spaced from the base 44, and less than the distance that the first protrusion 53*a* is spaced from the base 44. The third protrusion 53*c* is spaced from the base 44 a distance less than the distance that the first and second protrusions 53*a-b* are spaced from the base 44. Otherwise stated, the third protrusion 53*c* is disposed between the second protrusion 53*b* and the base 44 along the transverse direction T, and the second protrusion is disposed between the first and third protrusions 53*a* and 53*c* along the transverse direction T. Thus, the first and third protrusions 53*a* and 53*c* can be referred to as first and second outer protrusions, and the second protrusion 53*b* can be referred to as a middle protrusion that is spaced between the first and second outer protrusions along the transverse direction T. The protrusions 53*a-c* can define embossments of the respective first and second side walls 46*a-b*, or can be otherwise supported by the first and second side walls 46*a-b*, for instance attached to the first and second side walls 46*a-b*, as desired.

The first protrusions 52*a* and 53*a*, the second protrusions 52*b* and 53*b*, and the third protrusions 52*c* and 53*c*, can be aligned in respective first, second, and third rows such that the first and second guide members 52 and 53 define respective slots between the first and second rows, and the second and third rows. Accordingly, the first and second protrusions 52*a* and 52*b* of the first guide member 52 are spaced along the transverse direction T such that the first guide member 52 defines a first slot 54*a* that extends between the first and second protrusions 52*a* and 52*b* along the transverse direction T. The second and third protrusions 52*b* and 52*c* of the first guide member 52 are spaced along the transverse direction T such that the first guide member 52 defines a second slot 54*b* that extends between second and third protrusions 52*b* and 53*c* along the transverse direction T. The first and second slots 54*a* and 54*b* define a dimension in the transverse direction T that is at least equal or greater than the dimension of the respective first and second substrates 26*a* and 26*b* along the transverse direction T. Accordingly, the first slot 54*a* is sized to slidably receive the first substrate 26*a* along a predetermined direction, such as the longitudinal direction L, and the second slot 54*b* is sized to slidably receive the second substrate 26*b* along the predetermined direction, such as the longitudinal direction L.

Similarly, the first and second protrusions 53*a* and 53*b* of the second guide member 53 are spaced along the transverse direction T such that the second guide member 53 defines a first slot 55*a* that extends along the transverse direction T between the first and second protrusions 53*a* and 53*b*. The second and third protrusions 53*b* and 53*c* of the second guide member 53 are spaced along the transverse direction T such that the second guide member 53 defines a second slot 55*b* that extends along the transverse direction T between the second and third protrusions 53*b* and 53*c*. The first and second slots 54*a* and 54*b* define a dimension in the transverse direction T that is at least equal or greater than the dimension of the respective first and second substrates 26*a* and 26*b* along the transverse direction T. Accordingly, the first slot 54*a* is sized to slidably receive the first substrate 26*a* along the longitudinal direction L, and the second slot 54*b* is sized to slidably receive the second substrate 26*b* along the longitudinal direction L. Furthermore, the first and second slots 54*a* and 54*b* are aligned with the first and second slots 55*a* and 55*b*, respectively, along the longitudinal direction L, such that a straight line that extends along the longitudinal direction L and passes through the first slot 54*a* further passes through the first slot 55*a* of each side wall 46*a-b*, respectively. Further, a straight line that extends along the longitudinal direction L and passes through the second slot 54*b* further passes through the second slot 55*b* of each side wall 46*a-b*, respectively.

As described above, the first and second guide members 52 and 53, and thus the respective protrusions 52*a-c* and 53*a-c*, are spaced from each other along the longitudinal direction L so as to define a void 57 that can be configured as a gap between the first and second guide members 52 and 53, and extends from the first guide member 52 to the second guide member 53 along the longitudinal direction L. The void 57 is configured to receive an alignment member that cooperates with at least one or both of the substrates 26*a-b* so as to position the substrates 26*a-b* in a desired position in the housing 26. As will be appreciated from the description below, the first and second guide members 52 and 53 are configured to slidably receive the first and second substrates 26*a* and 26*b*, such that each side of the substrates 26*a-b* is supported by the housing 26 at two spaced locations, a first location defined by the first guide member 52 and a second location defined by the second guide member 53. It should be appreciated, of course, the first guide member 52 can define a length along the longitudinal direction L sufficient to support the substrates 26*a* and 26*b* alone, without the second guide member 53. Accordingly, the connector 20 can be said to include at least one guide member, such as the first guide member 52. The void 57 can thus be disposed adjacent the first guide member 52, for instance when the electrical connector 20 does not include the second guide member 53. When the electrical connector 20 includes the second guide member, the void 57 can be configured as a gap that extends between the first and second guide members 52 and 53. It should be further appreciated that the electrical connector 20 can include as many guide members as desired, such as at least one.

The first substrate 26*a* can be inserted through the second open end 50 of the first housing portion 38 and into the first slot 54*a*, at least into or through the void 57, and into the first slot 55*a*. Thus, the first substrate 26*a* can be captured between the first and second slots 54*a-b*, and further captured between the first and second slots 55*a-b*. The second substrate 26*b* can be inserted through the second open end 50 of the first housing portion 38 and into the second slot 54*b*, at least into or through the void 57, and into the second slot 55*b*. Thus, the second substrate 26*b* can be captured between the second and third slots 54*b-c*, and further captured between the second and third slots 55*b-c*. Thus, the slots 54*a* and 55*a*, and 54*b* and 55*b*, retain the respective substrates 26*a-b* substantially in respective horizontal planes that are defined by the longitudinal and lateral directions L and A. It should be appreciated that each of the guide members 52 and 53 can define as many slots as desired so as to receive a corresponding number of substrates. Thus, each guide member 52 and 53 can include at least a pair of projections that defines at least one slot configured to receive a corresponding substrate. The connector 20 can further include as many guide members as desired.

Figure 3:
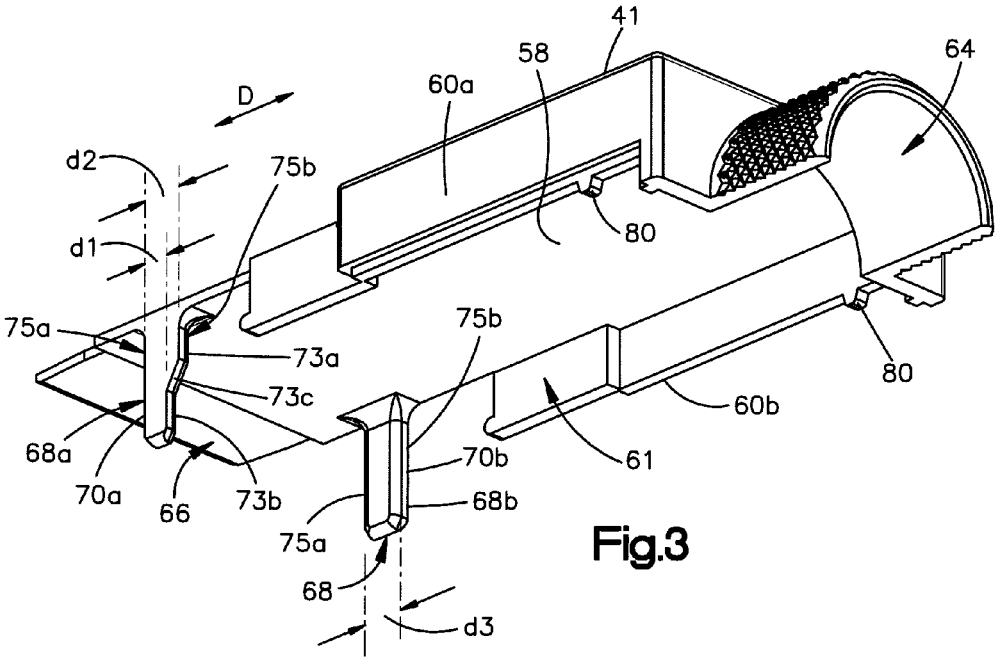
FIG. 3 is a perspective view of the second housing member illustrated in FIG. 1A.

The first housing portion 38 can further include at least one alignment member 56, such as a pair of alignment members 56 carried by the respective side walls 46. The alignment members 56 are configured to mate with complementary alignment members 80 (see FIG. 3) of the second housing portion 40 so as to facilitate attachment of the first and second housing portions 38 and 40 in a desired relative position. In accordance with the illustrated embodiment, the alignment members 56 are configured as recesses that are defined by the side walls 46, though it should be appreciated that the alignment members 56 can alternatively be configured as projections that extend from the side walls 46. Alternatively or additionally, the alignment members 56 can be configured as contours in the side walls 46 that correspond geometrically with complementary contours in the side walls of the second housing portion 40 so as to facilitate attachment of the first and second housing portions 38 and 40 in the desired relative position. It should be appreciated that the at least one alignment member 56 of the first housing portion 38 can be configured in any manner as desired so as to facilitate attachment to the second housing portion 40 in the desired relative position.

Referring now to FIGS. 1A-D and FIG. 3, the second housing portion 40 includes a body 41 that defines an upper wall 58 that can also define the upper wall of the connector housing 36, a first side wall 60*a* that extends out along the transverse direction T (or vertically down) from a first side of the upper wall 58, and a second side wall 60*b* that is opposite the first side wall 60*a* with respect to the lateral direction A, and also extends out along the transverse direction T (or vertically down) from a second side of the upper wall 58 that is opposite the first side along the lateral direction A. The upper wall 48 is spaced from the base 44 when of the first housing portion 38 along the transverse direction T when the first and second housing portions 38 and 40 are attached to each other. The upper wall 58 and the side walls 60 define a second interior portion 61 of the second housing portion 40. The first and second side walls 60*a-b* are configured to attach to the first and second side walls 46*a-b*, respectively, so as to attach the first and second housing portions 38 and 40 to each other, such that the connector housing 36 defines an interior 62 that includes the first and second interior portions 47 and 61 when the first and second housing portions 38 and 40 are attached to each other. The upper wall 58 can lie in a plane defined by the longitudinal and lateral directions L and A that is spaced along the transverse direction T from the plane that defines the base 44, such that the upper wall 58 is spaced above the base 44 when the first and second housing portions 38 and 40 are attached to each other.

The second housing portion 40 defines a first or front end 64 and a second or rear end 66 that is rearwardly spaced from the first or front end 64 along the longitudinal direction L. Thus, the first or front end 64 is forwardly spaced from the second or rear end 66 along the longitudinal direction L. The first end 64 can define a portion of the mounting interface 22, and can be shaped so as to correspond generally to a portion of an outer circumference of a cable, such that the cable can extend through the first end 64 and into the second interior 61. Thus, the first end 64 can be referred to as an open end that is configured to receive a cable. The first and 64 is aligned with the first end 48 of the first housing portion 38 when the first and second connector portions 38 and 40 are in the desired relative position, such that the first ends 64 and 48 cooperate to define the mounting interface 22 that can be configured as a ferrule that is sized to receive the cable. The second end 66 can also be configured as an open end, and can be substantially aligned with the second end 50 of the first housing portion 38 when the first and second housing portions 38 and 40 are attached to each other, such that the second ends 66 and 50 cooperate to define the mating interface 24 that is configured to receive a mating interface of a complementary electrical component, such as an electrical connector. While the second housing portion 40 has been described in accordance with the illustrated embodiment, it should be appreciated that the second housing portion 40 can define any suitable alternative shape and size as desired.

The second housing portion 40 can further include at least one alignment member 80, such as a pair of alignment members 80 carried by the respective side walls 60*a-b*. The alignment members 80 are configured to mate with the complementary alignment members 56 of the first housing portion 38 so as to facilitate attachment of the first and second housing portions 38 and 40 in the desired relative position. In accordance with the illustrated embodiment, the alignment members 80 are configured as projections that extend transversely out from the side walls 60, though it should be appreciated that the alignment members 80 can alternatively be configured as recesses that are defined by the side walls 60 as described above with respect to the alignment members 56. Alternatively or additionally, the alignment members 56 can be configured as contours of the side walls 60*a-b* that correspond geometrically with complementary contours of the side walls 46*a-b* of the first housing portion 38 so as to facilitate attachment of the first and second housing portions 38 and 40 in the desired relative position. It should be appreciated that the at least one alignment member 80 of the second housing portion 40 can be configured in any manner as desired so as to facilitate attachment to the first housing portion 38 in the desired relative position.

The connector housing 36, and in particular the second housing portion 40, further includes at least one first positioning member that is configured to engage a complementary at least one positioning member of at least one or both of the substrates 26*a-b* so as to retain the substrates 26*a-b* in a desired position with respect to the second housing portion 40, and thus also with respect to the first housing portion 38 when the first and second housing portions 38 and 40 are attached to each other. Thus, when the substrates 26*a* and 26*b* are supported by the first housing portion 38, and the first and second housing portions 38 and 40 are attached to each other in the desired relative position and the positioning members of the connector housing 36 and the substrates 26*a-b* are engaged, engagement of the positioning members of the connector housing 36 and the substrates 26*a-b* at least limits, for instance substantially prevents, the substrates 26*a-b* from moving along a predetermined direction, such the longitudinal direction L, with respect to the connector housing 36, thereby retaining the first and second substrates 26*a-b* in a desired position with respect to the connector housing 36 (and thus with respect to each of the first and second housing portions 38 and 40).

In accordance with the illustrated embodiment, the at least one positioning member 68 includes a first positioning member 68*a* and a second positioning member 68*b* that are carried by first and second laterally opposed sides of the second housing portion body 41. For instance, the first and second positioning members 68*a* and 68*b* can be configured as respective first and second positioning posts 70*a* and 70*b* that extend out (or vertically down) from the second housing portion body 41 along the transverse direction T. For instance, the first and second positioning posts 40 can extend from first and second sides of the upper wall 58, or can extend from the first and second side walls 60*a* and 60*b*, respectively, or can extend from other suitable location of the second housing portion body 41 as desired, directly or indirectly. Thus, it can be said that the first and second positioning members 68*a-b* are supported by the second housing body 41. In accordance with the illustrated embodiment, the first and second posts 70*a* and 70*b*, and thus the first and second positioning members 68*a* and 68*b*, can be integral and monolithic with the second housing portion body 41, or can be attached to the second housing portion body 41 as desired.

At least one or both of the positioning posts, such as the first positioning post 70*a*, can have a shape that is different than the second positioning post 70*b*. Alternatively, the first and second posts 70*a* and 70*b* can be shaped similarly with respect to each other, such that the at least one or both of the first positioning posts 70*a* and 70*b* can be shaped to bias the at least one substrate 26 into the predetermined position. For instance, the first positioning post 70*a* can define a first or proximal portion, such as a first end 73*a* that is attached to the second housing portion body 41, and a free second or distal portion, such as a second end 73*b* that extends from the proximal end along the transverse direction T. The first positioning post 70*a* can be stepped, such that the first end 73*a* defines a first dimension d1 along a select direction D, which can be substantially perpendicular to the transverse direction T, and the second end 73*a* defines a second dimension d2 that is different than the first dimension d1 along the select direction D. For instance, the select direction D can be substantially perpendicular to the transverse direction T, such as the longitudinal direction L which defines the insertion direction of the first and second substrates 26*a* and 26*b* into the first housing portion 38. Alternatively, the select direction can extend along the lateral direction A or any alternative direction that is angularly offset with respect to the longitudinal direction L.

In accordance with the illustrated embodiment, the first dimension d1 of the first end 73*a* is greater than the second dimension d2 of the second end 73*b* along the select direction D. For instance, first positioning post 70*a* can further include a third or intermediate portion 73*c* that extends between the first and second ends 73*a-b*. For instance, the third portion 73*c* can be tapered substantially linearly between the first and second ends 73*a* and 73*b*, or can be curved or otherwise shaped as desired. In accordance with the illustrated embodiment, the first positioning post 70*a* defines first and second sides 75*a* and 75*b*, respectively, that are spaced from each other along the longitudinal direction L such that the first side 75*a* is disposed rearward with respect to the second side 75*b*. Accordingly, the first side 75*a* is disposed between the second end 66 and the second side 75*b*. One of the first and second sides 75*a* and 75*b*, such as the first side 75*a*, can extend substantially linearly along the transverse direction T, and the other of the first and second sides, such as the second side 75*b*, can be contoured so as to define the first and second dimensions d1 and d2, and to further define the third portion 73*c*. Of course, it should be appreciated that the first positioning post 70*a* can be alternatively shaped as desired so as to define the first and second dimensions d1 and d2 as described above.

The second positioning post 70*b* can also define first and second sides 75*a* and 75*b*, respectively, that are spaced from each other along the longitudinal direction L such that the first side 75*a* is disposed rearward with respect to the second side 75*b*. In accordance with the illustrated embodiment, both the first and second sides 75*a* and 75*b* of the second positioning post 70 are substantially linear in the transverse direction T, such that the second positioning post 70*b* defines a substantially constant third dimension d3 in the select direction D along its length. The third dimension d3 can be less than, greater than, or substantially equal to either of the first and second dimensions d1 and d2 in the select direction. Alternatively, the second positioning post 70*b* can define first and second ends that define respective first and second different dimensions d1 in the select direction as described above with respect to the first positioning post 70*a*.

Figure 4A:
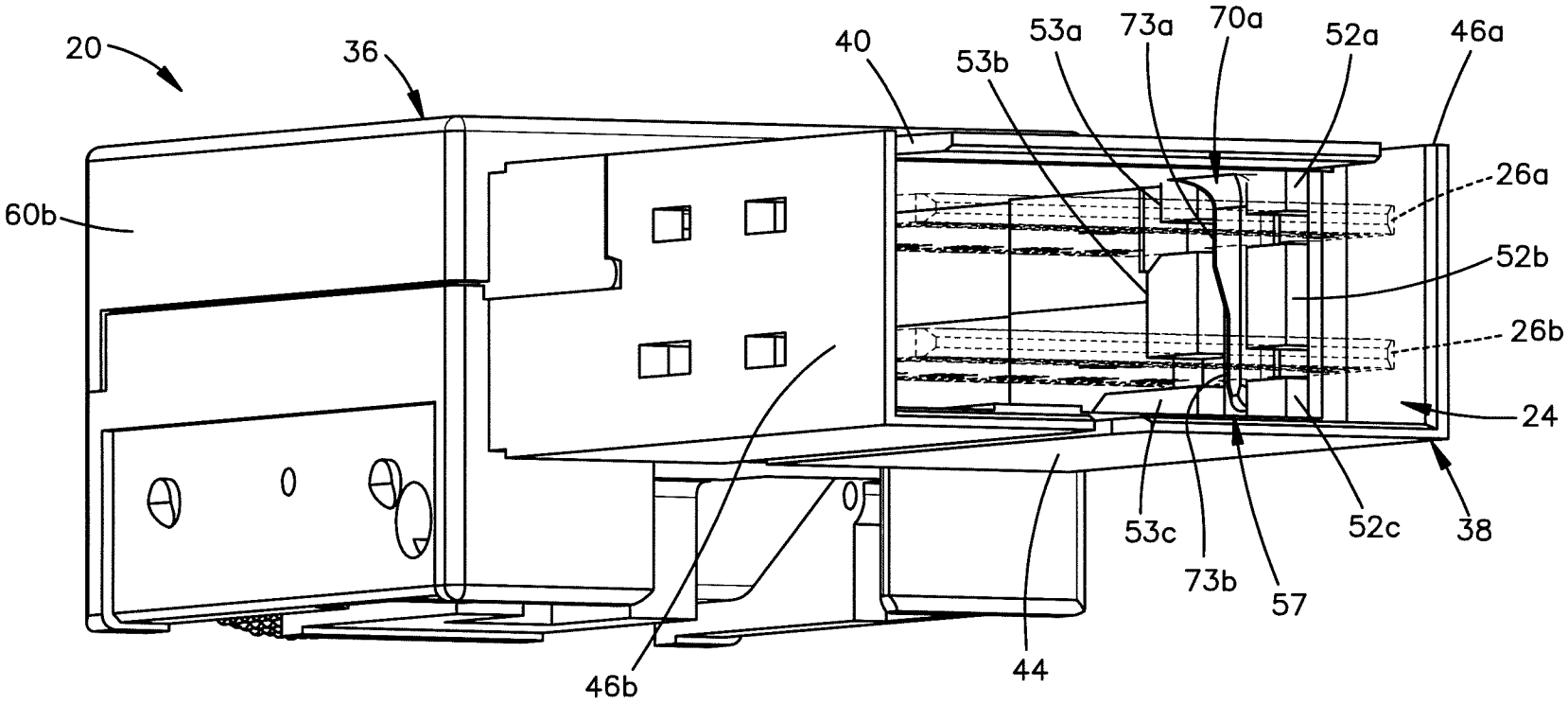
FIG. 4A is another perspective view of the electrical connector illustrated in FIG. 1A.
Figure 4B:
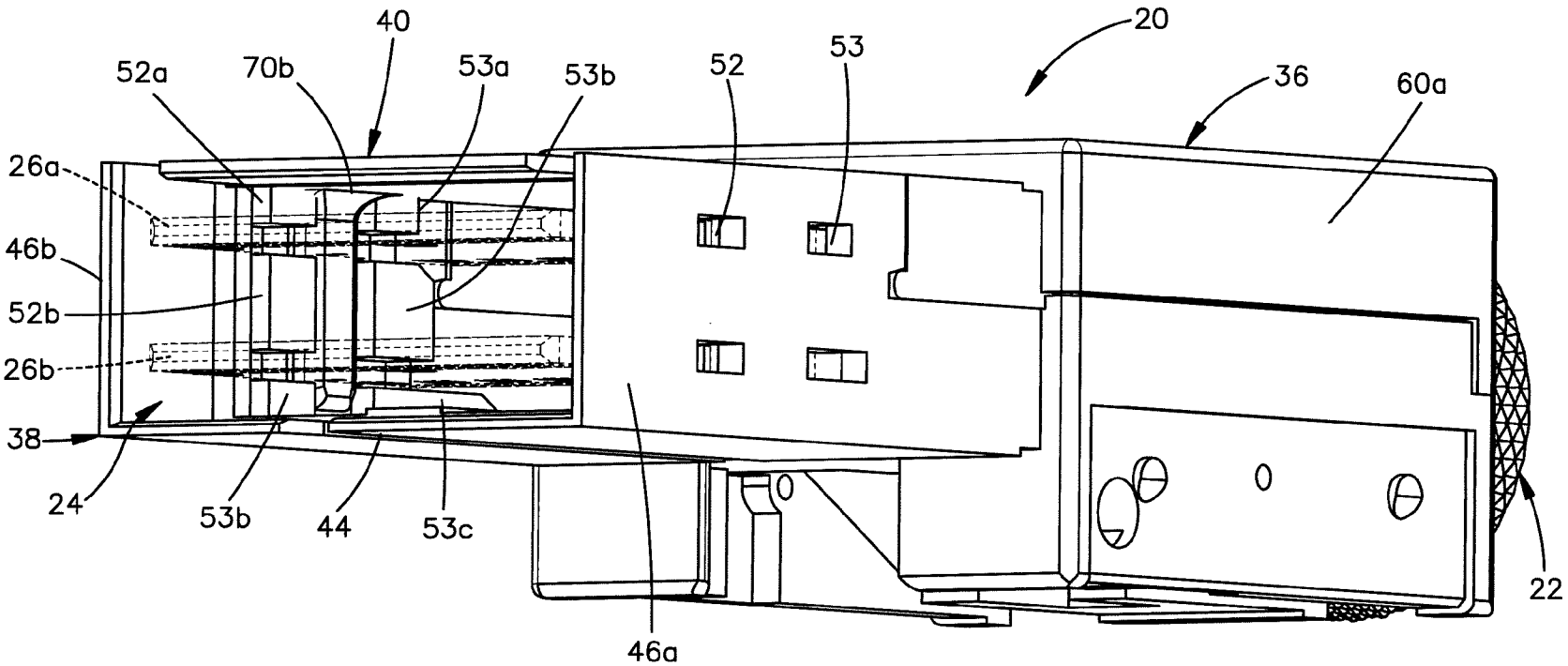
FIG. 4B is another perspective view of the electrical connector illustrated in FIG. 4A.

Referring also to FIGS. 4A-B, the first and second positioning posts 70*a-b* are configured and dimensioned to extend into the void 75 at a location adjacent at least one of the first and second guide members 52 and 53 along the longitudinal direction L, for instance between the guide members 52 and 53 when the first and second housing portions 38 and 40 attached to each other. Furthermore, the first and second positioning posts 70*a-b* can be aligned with the first and second guide members 52 and 53 of the respective first and second side walls 46*a* and 46*b*, such that a straight line that extends in the longitudinal direction L can pass through the first and second positioning posts 70*a-b* and the respective guide members 52 and 53 of the corresponding side walls 46*a* and 46*b*. Alternatively, the positioning posts 70*a-b* can be offset with respect to the respective guide members 52 and 53 along the lateral direction A as desired.

Referring now again to FIGS. 1B-C, each of the first and second substrates 26*a-b* can carry at least one positioning member 90 configured to align with and at least partially receive the first positioning member 68*a* of the second housing portion 40. In accordance with the illustrated embodiment, the at least one positioning member 90 of the first substrate 26*a* is sized to receive the first end 73*a* of the first positioning post 70*a*, and the at least one positioning member 90 of the second substrate 26*b* is sized to receive the second end 73*b* of the first positioning post 70*a*, and is further sized smaller than the first end 73*a* of the first positioning post 70*a*, such that the second substrate 26*b* prevents the first end 73*a* of the first positioning post 70*a* to extend into the positioning member 90 of the second substrate 26*b*.

In accordance with the illustrated embodiment, the at least one positioning member 90 of each of the first and second substrates 26*a* and 26*b* are configured as first and second apertures 92*a-b* that extend through the respective substrates 26*a-b* along the transverse direction T. For instance, each of the first and second substrates 26*a* and 26*b* defines a front end 27*a*, a rear end 27*b* spaced from the front end 27*a* along the longitudinal direction L, a first side 27*c* and a second side 27*d* that is spaced from the first side 27*c* along the lateral direction, an upper face 27*e* and a lower face 27*f* that is spaced from the upper face 27*e* along the transverse direction. The upper and lower faces 27*e* and 27*f* extend along respective parallel planes that can be defined by the longitudinal and lateral directions L and A when the first and second substrates are supported by the first housing portion 38. The first side 27*c* is juxtaposed with the first sides 46*a* and 60*a* of the first and second housing portions 38 and 40, and the second side 27*d* is juxtaposed with the second sides 46*b* and 60*b* of the first and second housing portions 38 and 40 when the first and second substrates 26*a-b* are inserted into the first housing portion 38 and the second housing portion 40 is attached to the first housing portion 38. The first and second apertures 92*a-b* extend from the upper face 27*e* through the lower face 27*f* along the transverse direction. The first apertures 92*a* can be disposed proximate to the first side 27*c*, and the second apertures 92*b* can be disposed proximate to the second side 27*d*. For instance, the first aperture 92*a* can be open to the first side 27*c* and the second aperture 92*b* can be open to the second side 27*d*. Alternatively, one or both of the first and second apertures 92*a* and 92*b* can be enclosed by the respective first and second substrates 26*a* and 26*b*. It should be appreciated that the substrates 26 can define as many additional apertures as desired.

The first apertures 92*a* can be configured to align with the first positioning post 70*a*, and the second apertures 92*b* can be configured to align with the second positioning post 70*b* when the first apertures 92*a* are aligned with the first positioning post 70*a* as the second housing portion 40 is attached to the first housing portion 38. As will now be described, the first aperture 92*a* of the first substrate 26*a* is sized to receive the first portion 73*a* of the first positioning post 70*a*, and the first aperture 92*a* of the second substrate 26*b* is sized to receive the second end 73*b* of the first positioning post 70*a*, but is sized smaller than the first end 73*a* of the first positioning post 70*a*, such that the first aperture 92*a* of the second substrate 26*b* is unable to receive the first end 73*a* of the first positioning post 70*a*. For instance, in accordance with the illustrated embodiment, the first aperture 92*a* of the first substrate 26*a* defines a dimension d4, or width, along the select direction D that is sized greater than the second dimension d2 of the second end 73*b* of the first positioning post 70*a* along the select direction D, and substantially equal to the first distance 73*a* of the first positioning post 70*a* along the select direction D. Further, in accordance with the illustrated embodiment, the first aperture 92*a* of the second substrate 26*b* defines a dimension d5, or width, along the select direction D that is sized substantially equal to the second dimension d2 of the second end 73*b* of the first positioning post 70*a* along the select direction D, and less than the first distance 73*a* of the first positioning post 70*a* along the select direction D.

Accordingly, when the first and second housing portions 38 and 40 are attached to each other with first substrate 26*a* positioned above the second substrate 26*b* and the first apertures 92*a* are at least partially substantially disposed in the void 57, the second end 73*b* of the first positioning post 70*a* passes through the first aperture 92*a* of the first substrate 26*a*, until 1) the first aperture 92*a* of the second substrate 26*b* receives the second end 73*b*, and 2) the first aperture 92*a* of the first substrate 26*a* receives the first end 73*a*. The second end 73*b* is disposed in the first aperture 92*a* of the second substrate 26*b* when the first and second housing portions 38 and 40 are attached to each other, and the first end 73*a* is disposed in the first aperture 92*a* of the first substrate when the first and second housing portions 38 and 40 are attached to each other. If the second substrate 26*b* were inadvertently positioned above the first substrate 26*a*, the first aperture 92*a* of the second substrate 26*b* would not receive the first end 73*a*, and the first end 73*a* would contact the second substrate 26*b*, thereby preventing the first and second housing portions 38 and 40 from attaching to each other.

It should be further appreciated that one or both of the first apertures 92*a* of the first and second substrates 26*a-b* can be sized smaller than the second positioning post 70*b* along the select direction D, such that the first apertures 92*a* are unable to receive the second positioning post 70*b*. Accordingly, at least one or both of the first and substrates 26*a-b* prevent insertion of the second positioning post 70*b* into the void 57 when the one or both of the first apertures 92*a* are aligned with the second positioning post 70*b*, as would be the case if either 1) the upper face 27*e* were positioned below the lower face 27*f*, for instance when the substrates 26*a-b* are oriented upside down, or 2) front end 34 of the substrates 26*a-b* is disposed between the rear end 50 of the first housing portion 38 and the rear end 36 of the substrates 26*a-b*, such as would be the case if the substrates 26*a-b* were inserted backwards. Furthermore, because the first and second apertures 92*a* and 92*b* are positioned off-center with respect to a midpoint between the front end rear ends 34 and 35 along the longitudinal direction, if the substrates 26*a-b* are inserted both upside down and backwards, the first and second apertures 92*a* and 92*b* would be misaligned with respect to the corresponding voids 57, and would not be positioned to receive the respective positioning posts 70*a* and 70*b*. Accordingly, it can be said that the first and second apertures 92*a-b* and the first and second positioning posts 70*a-b* are keyed such that contact between one or both of the first and second positioning posts 70*a-b* and at least one of the first and second substrates 26*a-b* prevents the first and second positioning posts 70*a-b* from extending through the respective first and second apertures 92*a-b* into the respective voids 57 if each of the substrates 26*a-b* are not in a desired orientation whereby 1) the upper face 27*e* is positioned above the lower face 27*f*, 2) the rear end 35 is positioned between the front end 34 and the rear end 50 of the first hosing portion 38, and 3) the first substrate 26*a* is disposed above the second substrate 26*b*.

A method of constructing the electrical connector 20 includes inserting the first and second substrates 26*a-b* forward along the longitudinal direction L into the first housing portion 38, and in particular into the respective first slots 54*a* and 55*a* and second slots 54*b* and 55*b*, respectively, until the apertures 92*a-b* are generally aligned with the respective voids 57 along the transverse direction T. The voids 57 of the first and second side walls 46*a* and 46*b*, respectively, can be sized at least equal to the first end 73*a* of the first alignment post 70*a* along the longitudinal direction L, and at least equal to the second alignment post 70*b* along the longitudinal direction L, as illustrated. Accordingly, when the second housing portion 40 is attached to the first housing portion 38, the first positioning post 70*a* is driven through the respective void 57 and into the first apertures 92*a* of the first and second substrates 26*a-b*. Because the first dimension d1 of the first end 73*a* is substantially equal to the dimension d4 of the first aperture 92*a* of the first substrate 26*a*, the first end 73*a* prevents the first substrate 26*a* from translating relative to the connector housing 36 along the longitudinal direction L when the first and second housing portions 38 and 40 are attached to each other. Furthermore, because the second dimension d2 of the second end 73*b* is substantially equal to the dimension d5 of the first aperture 92*a* of the second substrate 26*b*, the second end 73*b* prevents the second substrate 26*b* from translating relative to the connector housing 36 along the longitudinal direction L when the first and second housing portions 38 and 40 are attached to each other. Accordingly, the mating ends 36 of the substrates 26 can be disposed at a desired location with respect to the mating interface 24 of the connector housing 36, and the mounting ends 34 of the first and second substrates can be disposed at a desired location with respect to the mounting interface 22 of the connector housing 36.

The second apertures 92*b* of each of the first and second substrates 26*a* and 26*b* are each sized so as to define a dimension d6 along the select direction D that is substantially equal to the third dimension d3 of the second positioning post 70*b*, and is thus sized to receive the second positioning post 70*b* as the first and second housing portions 38 and 40 are attached to each other. Furthermore, because the second dimension d2 of the second end 73*b* is substantially equal to the dimension d6 of the second apertures 9*ba* of the first and second substrates 26*a-b*, the second positioning post 70*b* prevents the second substrate 26*b* from translating relative to the connector housing 36 along the longitudinal direction L when the first and second housing portions 38 and 40 are attached to each other. It should be appreciated that the second apertures 92*b* and the second positioning post 70*b* can be alternatively constructed as desired, for instance constructed as described above with respect to the first apertures 92*a* and the first positioning post 70*a*. Accordingly, the mating ends 36 of the substrates 26 can be disposed at a desired location with respect to the mating interface 24 of the connector housing 36, and the mounting ends 34 of the first and second substrates can be disposed at a desired location with respect to the mounting interface 22 of the connector housing 36.

The foregoing description is provided for the purpose of explanation and is not to be construed as limiting the invention. While various embodiments have been described with reference to preferred embodiments or preferred methods, it is understood that the words which have been used herein are words of description and illustration, rather than words of limitation. Furthermore, although the embodiments have been described herein with reference to particular structure, methods, and embodiments, the invention is not intended to be limited to the particulars disclosed herein. For instance, while the first housing portion 38 has been illustrated as the lower housing portion that carries the guide members 52 and 53, and the second housing portion 40 has been illustrated as the upper housing portion that carries the positioning members 68, it should be appreciated that the relative position of the housing portions 38 and 40 can be reversed. For instance, the first housing portion 38 can include the first and second guide members 52 and 53 and receive the substrates 26*a-b*, and the second housing portion 40 can include the first and second positioning members 68*a-b*. In this regard, it should be appreciated that one of the first and second housing portions 38 and 40 includes the guide members 52 and 53, and receives the substrates 26*a-b* in the respective slots 54*a-b* and 55*a-b*, and the other of the first and second housing portions 38*a* and 40 includes the positioning posts 70*a-b* that are received in the respective apertures 92*a-b* of the first and second substrates 26*a-b*.

Additionally, it should be understood that the concepts described above with the above-described embodiments may be employed alone or in combination with any of the other embodiments described above, unless otherwise indicated. Those skilled in the relevant art, having the benefit of the teachings of this specification, may effect numerous modifications to the invention as described herein, and changes may be made without departing from the spirit and scope of the invention as defined by the appended claims.

What is claimed:

1. An electrical connector configured to mate with a complementary electrical component, the electrical connector comprising:

a first substrate that defines a first positioning member that comprises a first aperture that extends through the first substrate;

a second substrate that defines a second positioning member that comprises a second aperture that extends through the second substrate;

a first housing portion that is configured to receive the first and second substrates along a predetermined direction so as to support the first and second substrates; and a second housing portion that includes at least one positioning member having a first portion and a second portion, the first and second portions defining respective different first and second dimensions along a select direction, such that the first portion of the positioning member is sized to extend through the first aperture, the second portion of the positioning member is sized to extend through the second aperture, and the first portion is sized greater than the second aperture along the select direction so as to at least limit the first and second substrates from moving along the predetermined direction with respect to the first housing portion when the first and second housing portions are attached to each other.

2. The electrical connector as recited in claim 1, wherein the positioning member of the at least one substrate is configured to receive the at least one positioning member of the second housing portion when the first and second housing portions are attached to each other.

3. The electrical connector as recited in claim 1, wherein the positioning member of the second housing portion prevents the at least one substrate from moving along the predetermined direction with respect to the first housing portion when the first and second housing portions are attached to each other.

4. The electrical connector as recited in claim 1, wherein the at least one positioning member of the second housing comprises at least one positioning post.

5. The electrical connector as recited in claim 4, wherein the apertures are open to a side of the respective first and second substrates.

6. The electrical connector as recited in claim 1, wherein the first housing portion comprises a first housing portion body and the positioning post extends from the housing portion, such that the first portion extends from the first housing portion body and the second portion is a free distal end.

7. The electrical connector as recited in claim 1, wherein the first dimension is greater than the second dimension along the select direction.

8. The electrical connector as recited in claim 6, wherein the positioning post comprises a third portion that extends between the first and second portions.

9. The electrical connector as recited in claim 8, wherein the third portion extends substantially linearly between the first and second portions.

10. The electrical connector as recited in claim 7, wherein the aperture of the first substrate defines a dimension that is at least substantially equal to the first dimension in the select direction, and the aperture of the second substrate defines a dimension that is at least substantially equal to the second dimension in the select direction.

11. The electrical connector as recited in claim 10, wherein the second portion of the positioning post extends through the aperture of the first substrate and into the aperture of the second substrate as the second housing portion is attached to the first housing portion, and the first portion of the positioning post extends into the aperture of the first substrate as the second housing portion is attached to the first housing portion.

12. The electrical connector as recited in claim 11, wherein the dimension of the aperture of the second substrate is substantially equal to the second dimension along the select direction, and the dimension of the first aperture is substantially equal to the first dimension along the select direction.

13. The electrical connector as recited in claim 12, wherein the select direction is the predetermined direction.

14. The electrical connector as recited in claim 12, configured to mate with a complementary electrical component along an insertion direction, wherein the predetermined direction is the insertion direction.

15. The electrical connector as recited in claim 14, wherein each of the first and second substrates define respective front and rear ends that are spaced from the front ends along the predetermined direction, and the apertures of the first and second substrates are positioned off-center with respect to a midpoint between the front end rear ends along the predetermined direction.

16. The electrical connector as recited in claim 12, wherein the first housing portion defines at least one guide member that defines a plurality of protrusions that define first and second slots that receive the first and second substrates, respectively, along the predetermined direction.

17. The electrical connector as recited in claim 16, wherein the first housing portion defines a void that is disposed adjacent the at least one guide member.

18. The electrical connector as recited in claim 17, wherein the at least one guide member is a first guide member, and the first housing portion further defines a second guide portion that is spaced from the first guide portion along the predetermined direction, the second guide portion defining a plurality of protrusions that define first and second slots that are aligned with the first and second slots of the first guide member along the predetermined direction, such that the first and second slots of the first and second guide members receive the first and second substrates, respectively.

19. The electrical connector as recited in claim 18, wherein the void is disposed between the first and second guide members, and is sized at least equal to the first portion of the alignment post.

20. The electrical connector as recited in claim 12, wherein the apertures of the first and second substrates comprise first apertures and the positioning post comprises a first positioning post, the second housing portion comprises a second positioning post sized, and the first and second substrates each define a second aperture that extend therethrough and is spaced from the first aperture, respectively, along a direction that is substantially perpendicular to the predetermined direction, the second apertures sized to receive the second positioning post.

21. The electrical connector as recited in claim 1, wherein the first housing portion is a lower housing portion that defines a base of the electrical connector, and the second housing portion is an upper housing portion that defines an upper end of the electrical connector, the upper end spaced above the base when the first and second housing portions are attached to each other.

22. The electrical connector as recited in claim 1, wherein the first and second housing portions define a housing that is configured to receive a cable so as to electrically connect the cable to each of the first and second substrates.

23. A method of constructing an electrical connector, comprising the steps of:

inserting first and second substrates into respective first and second slots of a first housing portion, each of the first and second substrates defining an aperture, the aperture of the first substrate sized greater than the aperture of the second substrate;

attaching a second housing portion to the first housing portion, the second housing portion including a positioning post that defines a first portion and a second portion, the first portion sized greater than the second portion along a select direction; and during the attaching step, inserting the second portion of the positioning post through the aperture of the first substrate and into the aperture of the second substrate, and further inserting the first portion of the positioning post into the aperture of the first substrate.

24. The method as recited in claim 23, further comprising preventing the first substrate from translating relative to the second housing portion along the select direction, by interference with the first portion of the positioning post, when the first and second housing portions are attached to each other.

25. The method as recited in claim 23, further comprising preventing the second substrate from translating relative to the second housing portion along the select direction, by interference with the second portion of the positioning post, when the first and second housing portions are attached to each other.

26. The method as recited in claim 23, wherein the first housing portion defines first and second guide members that define rails configured to receive the first and second substrates, and the second inserting step comprises inserting the first and second substrates between respective ones of the rails.

27. The method as recited in claim 26, wherein the attaching step comprises inserting the positioning post between the first and second guide members.

* * * * *